US006994299B2

(12) United States Patent
Marron

(10) Patent No.: US 6,994,299 B2
(45) Date of Patent: Feb. 7, 2006

(54) RAILROAD CROSSING APPARATUS HAVING IMPROVED RAIL CONNECTION AND IMPROVED FLANGEWAY FLOOR GEOMETRY AND METHOD INCORPORATING THE SAME

(75) Inventor: Gerald Marron, Broomall, PA (US)

(73) Assignee: CMI-Promex, Inc., Pedricktown, NJ (US)

( * ) Notice: Subject to any disclaimer, the term of this patent is extended or adjusted under 35 U.S.C. 154(b) by 0 days.

(21) Appl. No.: 10/735,995

(22) Filed: Dec. 15, 2003

(65) Prior Publication Data

US 2004/0124316 A1 Jul. 1, 2004

Related U.S. Application Data

(60) Provisional application No. 60/433,260, filed on Dec. 13, 2002.

(51) Int. Cl.
*E01B 7/04* (2006.01)

(52) U.S. Cl. ..... 246/382; 246/461

(58) Field of Classification Search ..... 246/454, 246/455, 457, 458, 460, 461, 384, 456, 276, 246/282, 265, 468, 275, 274, 382, 283
See application file for complete search history.

(56) References Cited

U.S. PATENT DOCUMENTS

| | | | | | |
|---|---|---|---|---|---|
| 211,607 | A | * | 1/1879 | Wharton | 246/457 |
| 254,693 | A | * | 3/1882 | Reed | 246/465 |
| 258,259 | A | * | 5/1882 | Staples | 246/464 |
| 497,554 | A | * | 5/1893 | Samuel et al. | 246/459 |
| 658,356 | A | * | 9/1900 | Du Pont | 246/459 |
| 815,869 | A | * | 3/1906 | Shoemaker | 246/454 |
| 1,348,447 | A | * | 8/1920 | Reid | 246/456 |
| 3,022,968 | A | * | 2/1962 | McGrath | 246/468 |
| 3,480,072 | A | * | 11/1969 | Heim et al. | 164/93 |
| 4,514,235 | A | | 4/1985 | Augustin et al. | |
| 5,042,755 | A | * | 8/1991 | Testart | 246/385 |
| 5,082,214 | A | | 1/1992 | Testart | |
| 5,100,046 | A | | 3/1992 | Allegrucci et al. | |
| 5,170,932 | A | | 12/1992 | Blumauer | |
| 5,375,797 | A | | 12/1994 | Willow | |
| 5,413,442 | A | | 5/1995 | Grey | |
| 5,496,004 | A | * | 3/1996 | Kuhn | 246/470 |
| 5,531,409 | A | | 7/1996 | Willow | |
| 5,598,783 | A | | 2/1997 | Lund | |
| 5,618,013 | A | | 4/1997 | Mugg | |
| 5,622,312 | A | | 4/1997 | Martin | |
| 5,746,400 | A | | 5/1998 | Remington et al. | |
| 5,845,881 | A | | 12/1998 | Young et al. | |
| 5,918,806 | A | | 7/1999 | Keightley et al. | |
| 6,177,205 | B1 | | 1/2001 | Kais et al. | |
| 6,266,866 | B1 | * | 7/2001 | Ramirez et al. | 29/527.6 |

* cited by examiner

*Primary Examiner*—Frantz F. Jules
(74) *Attorney, Agent, or Firm*—Michael B. Fein; Cozen O'Connor, P.C.

(57) ABSTRACT

An improved railroad frog, and method incorporating the same, for facilitating the intersection of rail lines in a more efficient, effective, and durable manner. In one aspect the invention is a railroad frog apparatus comprising: a body having flangeways that intersect; and at least one connection plug extending from the body for connecting to a running rail; the at least one connection plug having a cross-sectional profile that is substantially identical to a cross-sectional profile of the running rail. In another aspect the invention is a railroad frog apparatus having at least one flangeway having a floor with a convex surface formed of at least one arc. Such geometric surface shape of the floor reduces rail batter, undesirable vibration, and damage to train wheels.

5 Claims, 7 Drawing Sheets

Figure 1: Prior Art

Figure 2: Prior Art

RAILROAD CROSSING APPARATUS HAVING IMPROVED RAIL CONNECTION AND IMPROVED FLANGEWAY FLOOR GEOMETRY AND METHOD INCORPORATING THE SAME

CROSS-REFERENCE TO RELATED APPLICATION

This applications claims the benefit of U.S. Provisional Application 60/433,260, filed Dec. 13, 2002, which is hereby incorporated by reference in its entirety.

TECHNICAL FIELD OF THE INVENTION

The present invention relates generally to flange bearing railroad frogs and more specifically to flange bearing railroad frogs having improved rail connection capabilities and improved flangeway surface geometries for smooth wheel transition.

BACKGROUND OF THE INVENTION

In the railroad industry, whenever it is necessary for one rail to cross over another, as in a turnout or crossing, a railroad frog is used to facilitate the crossing of the train's wheel over the intersecting rail. Originally, railroad frogs were constructed of rail sections, flangeway filler bars, and blocks bolted together. This style of railroad frog was not very desirable because the train wheel, riding on its tread, would have to "jump" across the flangeway of the intersecting rail, resulting in severe impact on both the train wheel and the railroad frog. This severe impact caused damage to the railroad frog, the train wheel, and the roadbed, not to mention passenger discomfort and undesirable noise.

As railroad tonnage and use increased, railroad frogs were developed that allowed train wheels to pass over the flangeway gap by riding on their flanges rather than their treads. This is accomplished by diminishing the depth of the flangeway in the area of the gap so that the flange contacts the flangeway floor, lifting the tread slightly above the top of the rail and supporting the wheels full load. Upon passing over the intersecting rail's flangeway gap the flangeway depth increases, resulting in the tread once again contacting the top of the rail and the flange being lifted from the flangeway floor. Existing flange bearing railroad frogs accomplish this lifting and setting-back down of the tread by linearly ramping the flangeway floor. Flange bearing railroad frogs are typically constructed of cast manganese for increased strength and durability. While at one time flange bearing railroad frogs were used solely for light weight transit systems, their application has become standard in the industry. Examples of flange bearing railroad frogs are described in U.S. Pat. No. 5,845,881, Young et al., and U.S. Pat. No. 5,746,400, Remington et al., the teachings of which are hereby incorporated by reference in their entireties.

For a single railroad intersection (i.e., where one set of railroad tracks crosses another), a total of four railroad frogs are used. A frog must be connected to each of the intersecting running rails (i.e., the rails on which the train actually travels) on both sides. Thus, each frog has four running rail connection areas positioned so that the flange of the train wheel can properly enter and exit the flangeway of the frog and remain travelling on the running rail. Traditionally, the connection areas of railroad frogs are made from manganese steel castings that are bolted to the running rails.

Referring to FIG. 1, prior art railroad frog 100 is illustrated. Prior art railroad frog 100 is of the bolt connection type and connects to running rails 105 and 110 via bolts (not shown) that extend through bolt holes 120 and corresponding holes of rails 105 and 110. Nuts (not shown) are then used to threadily engage the bolts, thereby securing the running rails 105 and 110 to prior art railroad frog 100. Connecting railroad frogs to running rails via bolted connections has proved to be less than optimal. As time passes, bolted connections are subjected to repetitive loading and unloading by trains crossing the frog time and time again. These loading-unloading cycles, and the vibrations associated therewith, eventually cause the bolted connections to loosen. Loosening of the bolted connections is exacerbated due to rail batter.

Loosening of bolted connections requires consistent maintenance that can be cumbersome, time consuming, and expensive. The problems and costs associated with maintaining bolted connections are significantly increased for tracks that are buried under pavement or dirt because the pavement needs to be dug up to tighten the bolts. Moreover, the "play" in loosened bolt connections can cause potholes in the pavement near the connection.

Thus, a need exists for a railroad frog suited for better connection to the running rails. While attempts have been made to more effectively connect running rails to manganese steel cast frogs, these methods are either ineffective or expensive. Attempts have been made to eliminate the need for bolted connections by welding the running rails to the manganese cast frog connection points. However, because running rails are typically made of hardened steel, not manganese, it is very difficult, if not impossible, to achieve an acceptable weld between manganese and hardened steel due to the differences in material properties (such as heat conductivity, weight, etc.). In attempts to remedy these welding problems, methods have been developed where one or more intermediate pieces, such as a bainic steel piece and/or a pearlitic steel piece, are first welded to the frog. Such methods are disclosed in U.S. Pat. No. 5,170,932, Blumauer, and European Patent Applications 0602728 and 0602729, both Connelly, et al. However, these methods require that multiple welds be made for each connection. The existence of multiple welds per connection results in an increased probability that a weld will eventually fail. Additionally, these welds are very difficult to achieve and either require special equipment or can not be easily performed in the field.

While steel cast railroad frogs do exist that are capable of having running rails welded directly thereto, these welds are often difficult to properly perform and/or result in less than optimal welds. This is due to the configuration of the connection areas of the frog to which the steel rails must be welded.

An additional problem with existing railroad frogs is that of rail batter. As a train crosses a frog and transitions from being supported by the running rail to being supported by the frog, which also corresponds to the transition from tread support to flange support, the flange of the train wheel impacts the linearly ramped floor of the flangeway, resulting in impact on the wheel and the frog. This impact not only damages the frog and the wheel, but also causes unwanted vibration throughout the system that can loosen or otherwise compromise joint connections. This is known as rail batter. It is believed that the problem of rail batter can be reduced by properly modifying the surface geometries of the flangeway floors of the frog.

Referring now to FIG. 2, a cross sectional view of flangeway 130 of prior art railroad frog 100 (FIG. 1) is illustrated. The cross sectional view of FIG. 2 is take along lines 2—2 of FIG. 1. Flangeway 130 has a linearly ramped floor. When a train wheel (not illustrated) is travelling through linearly ramped flangeway 130 from left to right, the initial flangeway depth is deep enough so that the flange portion of the train wheel is not in contact with horizontal floor 131. As such, the tread of train wheel rests on top surface 140 of the flangeway wall. As used herein, flangeway depth is equal to the vertical distance from the floor of the flangeway to the top surface of the flangeway wall. As the train wheel proceeds through flangeway 130, the train wheel will contact linear ramp 132. As the train wheel continues up linear ramp 132, the flangeway depth linearly decrease until, at some point, the tread of the train wheel is lifted from top surface 140 and the load of the train is supported solely by the flange. The train wheel flange continues along floor 133 until it starts travelling down linear ramp 134. The flangeway depth decreases as the flange travels down ramp 134 until a point is reached where the flangeway depth is greater than the length of the flange. At this point, the tread of the wheel contacts top surface 140 and supports the load once again. Because ramp 132 and 134 are linear, the train wheel flange abruptly contacts ramp 132 upon entering flangeway 130, and the train wheel tread abruptly contacts top surface 140 upon leaving fangeway 130. These abrupt contact points put great stresses on the train wheel, the prior art frog 100, and the bolted connections. As a result of these stresses, damage and vibration occur.

DISCLOSURE OF THE INVENTION

It is an objective of the present invention to provide a railroad frog apparatus that can be more easily and effectively connected to any type of running rail.

Another objective of the present invention is to provide a railroad frog apparatus and method that requires less maintenance.

Yet another objective of the present invention is to provide a railroad frog apparatus and method that reduces rail batter and other detrimental impact forces to the railroad frog apparatus and a train wheel during use.

Still another objective of the present invention is to provide a railroad frog apparatus and method that can be more easily and quickly installed in the field.

It is a still further objective of the present invention to provide a railroad frog apparatus and method that can be installed and/or manufactured in a more cost effective and timely manner.

These objects and others are solved by the present invention which in one aspect is a railroad frog apparatus for connecting intersecting rail lines comprising: a body having flangeways that intersect and at least one connection plug extending from the body. The at least one connection plug connects to a running rail and has a cross-sectional profile that is substantially identical to the cross-sectional profile of the running rail to which it will be connected.

Preferably, the inventive crossing frog apparatus has four connection plugs extending from the body wherein each connection plug has a cross sectional profile that is substantially identical to the cross sectional profile of the running rail to which that connection plug will connect. By making the cross sectional profile of each connection stub substantially identical to the running rail to which it will be connected, ease of welding is facilitated. As such, the running rails can be welded to the crossing frog in an effective and durable manner. Because bolts are not used, and because a single weld will properly connect each running rail, maintenance of the connections is reduced.

When used to facilitate the intersection of two different types of runing rails (i.e. running rails with different cross-sectional profiles), two of the four connection plugs will have cross sectional profiles substantially identical to the cross sectional profile of the first type of running rail while the remaining two connection stubs will have cross sectional profiles substantially identical to the cross sectional profile of the second type of running rail.

It is further preferable that the connection plugs extend from the body of the railroad frog apparatus a distance that allows the running rail to be connect by a Thermite weld. For ease of manufacture, reduction of maintenance, and facilitation of a competent weld, the railroad frog apparatus is preferably machined from a single piece of rail steel.

In order to reduce rail batter and/or unwanted vibrations, a floor of at least one of the flangeways has a specialized surface geometry. In one embodiment, at least a portion of the floor is convexly shaped in the form of an arc. This arc extends between a first point and a second point. The floor is designed so that the first and second points are at flangeway depths that avoid contact with the flange of a train wheel passing through the flangeway. It is preferred that the arc be of constant radius.

In another embodiment, the floor of at least one of the flangeways can take on a convex geometry having a triple radius make up. In this embodiment, the floor has a convex portion defined by a first arc, a second arc and a third arc. The first arc extends from a first point to a second point. The second arc extends from the second point to a third point. The third arc extends from the third point to a fourth point. In order to avoid abrupt impact with the a train wheel as it enter and leaves the flangeway, the first and fourth points are at flangeway depths so as to avoid contact with the flange of train wheel passing through the flangeway. Moreover, in order to smooth the transition of the train wheel into and out of the flangeway, the floor is designed so that the flange of the train wheel upon entering the flangeway contacts the floor at a point on the first arc, and upon the train wheel exiting the flangeway, the flange of the train wheel disengages the floor at a point on the third arc. The first arc, the second arc, and third arc are preferably all of approximately constant radius.

In another aspect, the invention is a railroad frog apparatus for connecting intersecting rail lines comprising: a body having flangeways that intersect and a plurality of connection plugs extending from the body for connecting to a running rail; wherein at least one of the flangeways has a floor having a convex portion defined by an arc extending between first and second points, the first and second points being at flangeway depths that avoid contact with the flange of a train wheel passing through the flangeway.

In yet another aspect, the invention is a railroad frog apparatus for connecting intersecting rail lines comprising: a body having flangeways that intersect and a plurality of connection plugs extending from the body for connecting to a running rail; wherein at least one of the flangeways has a floor having a convex portion defined by a first arc, a second arc and a third arc; the first arc extending from a first point to a second point; the second arc extending from the second point to a third point; the third arc extending from the third point to a fourth point; the first and fourth points being at flangeway depths so as to avoid contact with a flange of train wheel passing through the flangeway; wherein upon the train wheel entering the flangeway, the flange of the train wheel initially contacts the floor at a point on the first arc; and wherein upon the train wheel exiting the flangeway, the flange of the train wheel disengages the floor at a point on the third arc.

In still another aspect, the invention is a method of connecting two running rails for intersection in a railroad comprising: providing a railroad frog apparatus having a body with two intersecting flangeways and four connection plugs extending from the body, each of the connection plugs having cross-sectional profiles that are substantially identical to a cross-sectional profile of a corresponding running rail to which the connection plug is to be connected; butting the corresponding running rail against each of the connection plugs; and welding each corresponding running rail to the connection plug it is butted against. Preferably, the weld is a thermite weld and the railroad frog apparatus is machined from a single piece of rail steel. As mentioned above, the surface geometry of the floor of the flangeways can be specially designed to reduce rail batter and/or unwanted vibration.

DETAILED DESCRIPTION OF THE DRAWINGS

Figure 1:
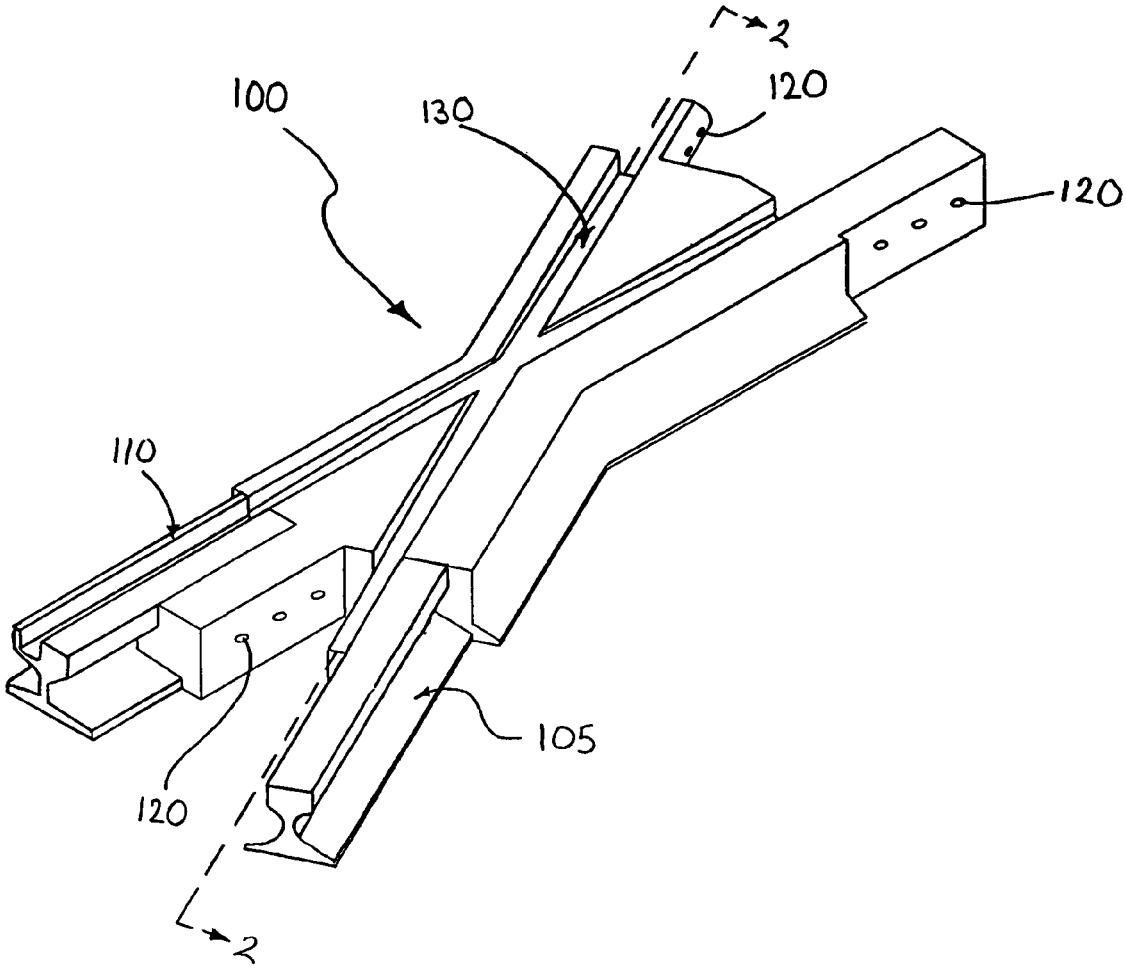
FIG. 1 is a perspective view of a prior art railroad frog having two running rails position for a bolting connection thereto.
Figure 2:
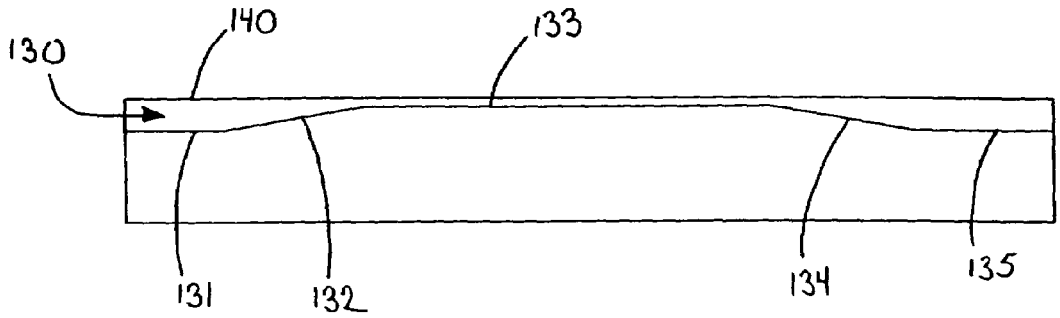
FIG. 2 is a cross sectional view along line 2—2 of FIG. 1 illustrating the the flangeway floor of the prior art railroad frog.
Figure 3:
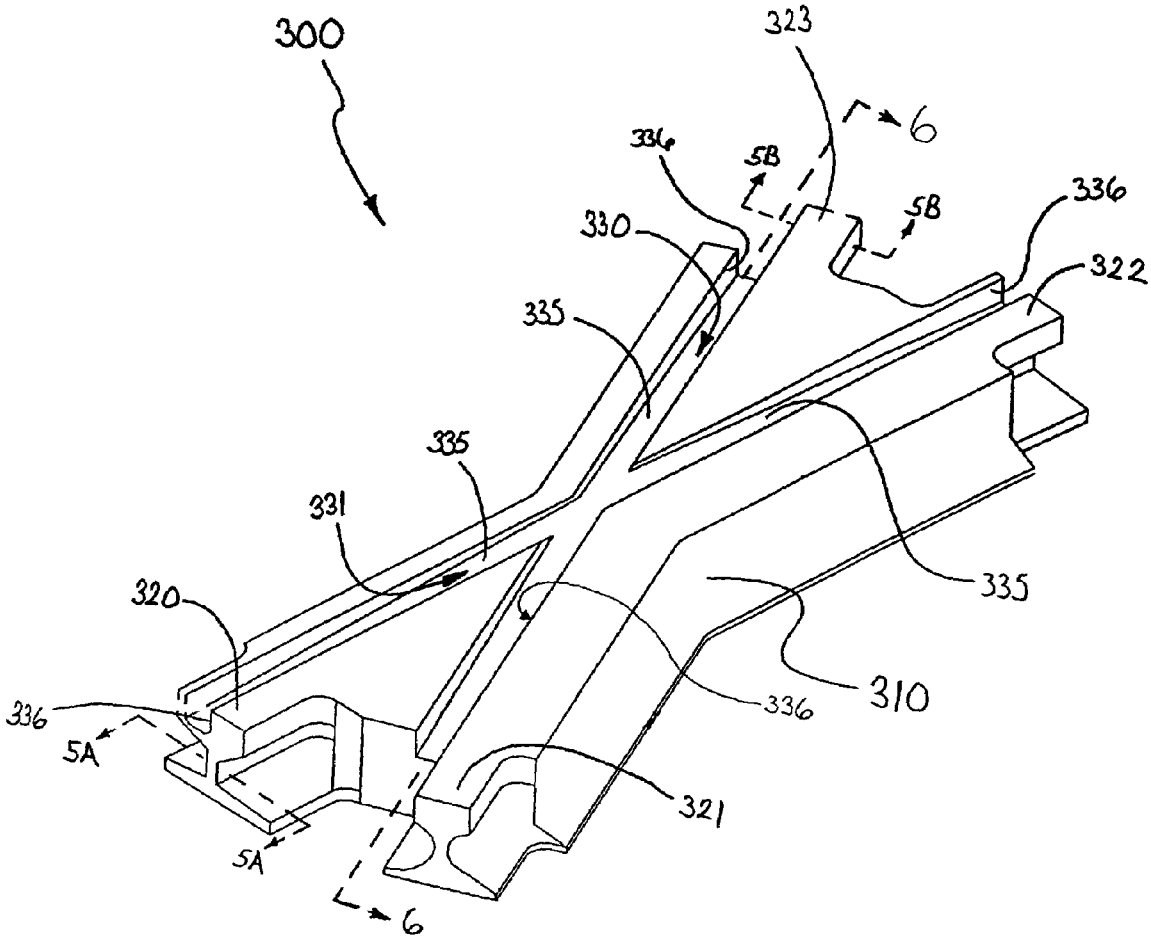
FIG. 3 is a perspective view of a railroad frog according to an embodiment of the present invention.

FIG. 3 illustrates railroad frog 300 according to an embodiment of the present invention. Railroad frog 300 is a one piece construction machined from a single block of rail steel. Railroad frog 300 comprises body 310. Body 310 has four connection plugs 320–323 extending therefrom. Flangeways 330 and 331 extend through body 310 for facilitating a train wheel to pass over railroad frog 300 on its flange. Flangeway 330 provides a pathway for the flange of the train wheel that rides on the running rails that connect to connection plugs 321 and 323. Flangeway 331 provides a pathway for the flange of the train wheel that rides on the running rails that connect to connection plugs 320 and 322. Flangeways 330 and 331 intersect near the middle of body 310.

Figure 5A:
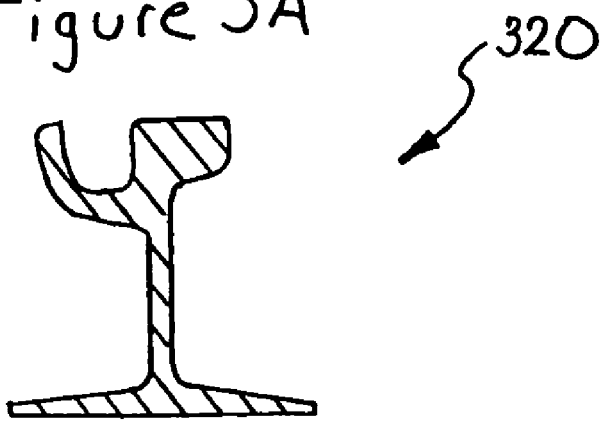
FIG. 5A is a cross sectional view along line 5A—5A of FIG. 3
Figure 5B:
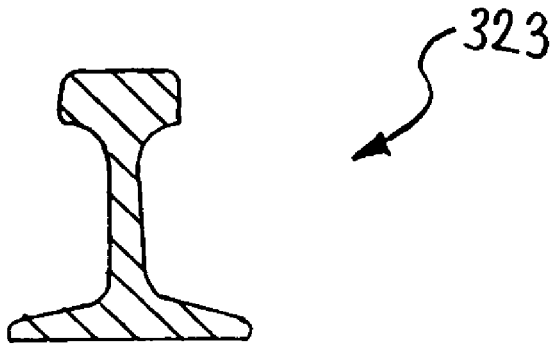
FIG. 5B is a cross sectional view along line 5B—5B of FIG. 3

Connection plugs 321–323 are formed so as to have cross sectional profiles that are substantially identical to the cross sectional profile of the type of running rail that is to be attached thereto. Railroad frog 300 is specifically designed for use at the intersection of a rail line built from 115RE Rail Contour rail and a rail line built from RI-59 Rail Contou rail. As such, connection plugs 320 and 322 have cross sectional profiles that are substantially identical to the cross sectional profile of a 115RE Rail Contour running rail (best illustrated in FIG. 5A). Connection plugs 320 and 322 are designed to be used to connect the 115RE Rail Contour running rails to railroad frog 300. Connection plugs 321 and 323 have cross sectional profiles that are substantially identical to the cross sectional profile of a RI-59 Rail Contour running rail (best illustrated in FIG. 5B). Connection plugs 321 and 323 are designed to be used to connect RI-59 Rail Contour running rails to railroad frog 300. While specific rail contours have been illustrated, railroad frog 300 can be used at the intersection of any type of running rails so long as each connection plug is formed to have a cross-sectional profile that is substantially identical in size and shape to the cross sectional profile of the corresponding running rail that is attached to that specific connection plug. Thus, the invention is not limited to any specific cross sectional profile.

Frog 300 can be constructed of the same steel used to make rails. By ensuring that connection plugs 320–323 have cross-sectional profiles substantially identical to the running rail to which they are connected, the running rails can be easily welded to connection plugs 320–323 using conventional welding techniques, such as a Thermite welding. Connection plugs 320–323 extend from body 310 a sufficient length so that a Thermite weld can be performed.

Figure 4:
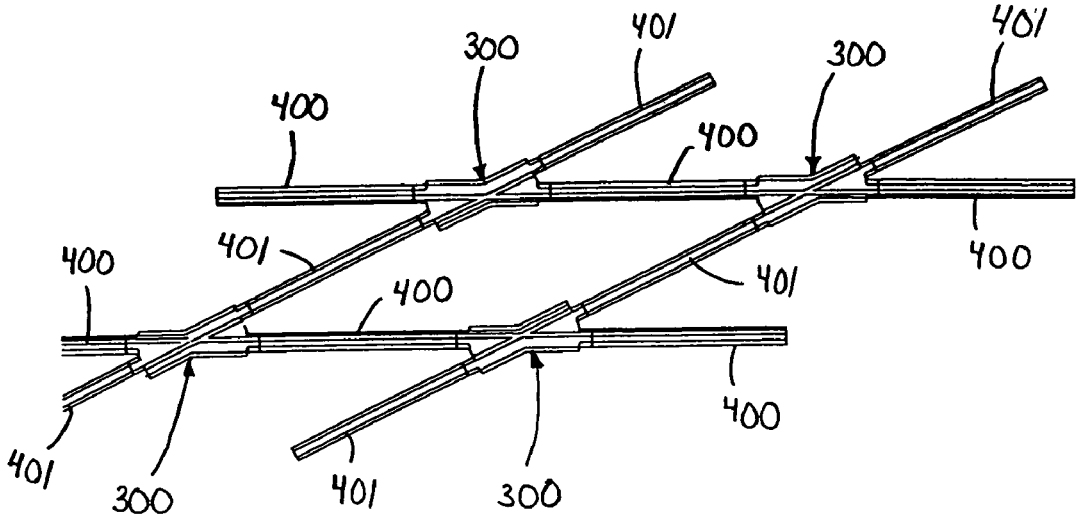
FIG. 4 is a top view of a railroad line crossing incorporating four of the railroad frog illustrated in FIG. 3.

Referring now to FIG. 4, when used in the field to facilitate the intersection of two railroad lines, four railroad frogs 300 must be used. Each railroad frog 300 is connected to four pieces of running rails 400 and 401 at connection stubs 320–323 (FIG. 3) In the specific illustrated embodiment, railroad frogs 300 are used to facilitate the intersection of a rail line constructed of RI-59 Rail Contour running rail 401 and a rail line constructed of 115RE Rail Contour running rail 400.

Referring back to FIG. 3, each of flangeways 330 and 331 have a flangeway floor 335 and flangeway wall 336. The surface geometry of floor is specially designed to reduce rail batter and unwanted vibration.

Figure 6:
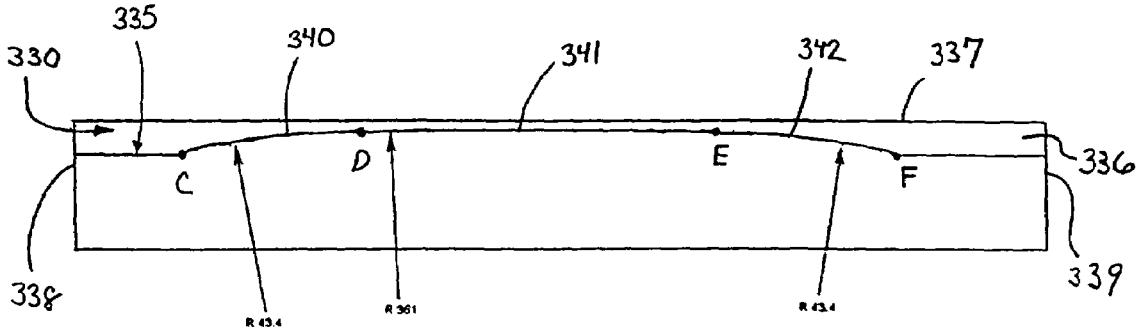
FIG. 6 is a cross sectional view along line 6—6 of FIG. 3 illustrating flangeway floor surface geometry.

Referring to FIG. 6, a cross sectional profile of flangeway 330 is illustrated along line 66—6. The following discussion is equally applicable to flangeway 331 but is omitted to avoid redundancy. The surface of floor 335 is shaped so at to comprise three arcs 340–342. First arc 340 extends from point C to point D. Second arc 341 extends from point D to point E. Third arc 342 extends from point E to point F. Arcs 340–342 are of constant radius, and have a radius of 43.1 inches, 36.1 inches and 43.4 inches, respectively. However, the invention is not limited to any specific radii measurements for the arcs. The optimal radii for any specific frog will depend on the design needs and size restrictions for that specific job.

Flangeway 330 is designed so that when a train wheel first enters flangeway 330, the train wheel (not illustrated) is entirely supported by the tread of the train wheel on upper surface 337 of flangeway wall 336. The flangeway depth from ends 338 and 339 to points C and F respectively is greater than the length of the train wheel's flange. As used herein, flangeway depth is equal to the vertical distance from floor 335 to upper surface 337 of flangeway wall 336. As such, points C and F are at a flangeway depth that prevents a train wheel's flange from contacting floor 335 at those points. Assuming a train wheel passes thorough flangeway 330 from left to right, the flange of the train wheel will first contact floor 335 at first arc 340 at a point between points C and D. As the train wheel continues travelling up first arc 340, the flangeway depth gradually decreases until the tread of the train wheel lifts off upper surface 337. Once this happens, the load of the train wheel is fully supported by the wheel's flange on floor 335. The train wheel continues passing through flangeway 330, through arc 341, with the train wheel entirely supported by its flange. Until the flange begins travelling down arc 342, where the flangeway depth gradually increases until at some point between points E and F, the tread of the wheel contacts upper surface 337 and bears the wheel load. At this point, the flange of the wheel disengages and no longer contacts floor 335. The use of three arcs 340–342 smoothes the transition of the train wheel as discussed above, resulting in less impact on frog 300 and the train wheel itself. Furthermore, the use of a triple radii floor allows the flangeway depth near ends 338 and 339 to be increased without increasing the length of frog 300 or the slope of the ramps. This helps reduce the possibility of the flange from abruptly impacting and chipping floor 335 as it enters frog 300. The exact length of the radii used can vary.

Figure 7:
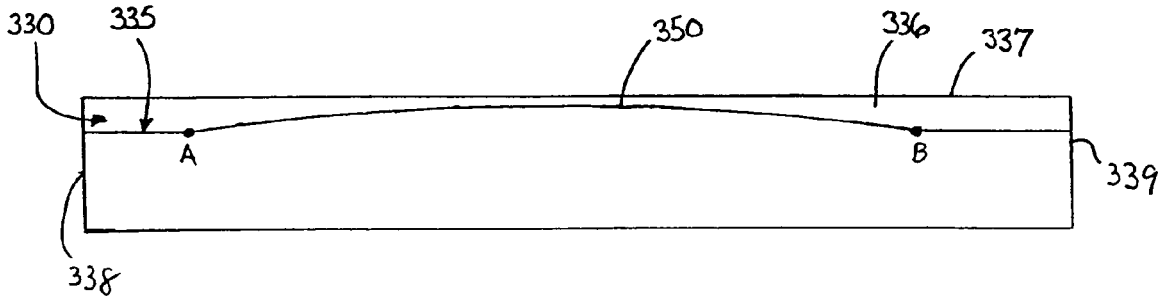
FIG. 7 is a cross sectional view of an alternative embodiment of a profile for a flangeway floor of surface geometry according to an embodiment of the present invention.

Referring now to FIG. 7, a second embodiment of specialized floor geometry for flangeway 330 is illustrated that will decrease rail batter and unwanted vibrations. In this embodiment, floor 335 can be shaped so at to comprise only a single arc 350 that extends from point A to point B. Floor 335 is designed so that points A and B are at a sufficient flangeway depth so that the flange of train wheel will not contact the floor 335 at those points. As such, the above principles will apply as a train wheel passes therethrough.

While the invention has been described and illustrated in sufficient detail that those skilled in this art can readily make and use it, various alternatives, modifications, and improvements should become readily apparent without departing from the spirit and scope of the invention.

What is claimed is:

1. A railroad frog apparatus for connecting intersecting rail lines comprising:

a body having flangeways that intersect;

at least one connection plug extending from the body for connecting to a running rail;

the at least one connection plug having a cross-sectional profile that is substantially identical to a cross-sectional profile of the running rail; and wherein at least one of the flangeways has a floor surface having a convex cross-section defined by a first arc, a second arc and a third arc; the first arc extending from a first point to a second point; the second arc extending from the second point to a third point; the third arc extending from the third point to a fourth point; the first and fourth points being at flangeway depths so as to avoid contact with a flange of a train wheel passing through the flangeway; wherein upon the train wheel entering the flangeway, the flange of the train wheel initially contacts the floor at the first arc; and wherein upon the train wheel exiting the flangeway, the flange of the train wheel disengages the floor at the third arc.

2. The railroad frog apparatus of claim 1 wherein the first arc, the second arc, and third arc are all of approximately constant radius.

3. A railroad frog apparatus for connecting intersecting rail lines comprising:

a body having two flangeways that intersect;

at least one connection plug extending from the body for connecting to a running rail, the at least one connection plug having a cross-sectional profile that is substantially identical to a cross-sectional profile of the running rail;

the at least one connection plug extending from the body a distance that allows the running rail to connect to at least one connection plug by a termite weld;

wherein the apparatus is machined from a single piece of rail steel; and wherein at least one of the flangeways has a floor surface having a convex cross-section defined by a first arc of constant radius, a second arc of constant radius and a third arc of constant radius; the first arc extending from a first point to a second point; the second arc extending from the second point to a third point; the third arc extending from the third point to a fourth point; the first and fourth points being at flangeway depths so as to avoid contact with a flange of a train wheel passing through the flangeway; wherein upon the train wheel entering the flangeway, the flange of the train wheel initially contacts the floor at the first arc; and wherein upon the train wheel exiting the flangeway, the flange of the train wheel disengages the floor at the third arc.

4. A railroad frog apparatus for connecting intersecting rail lines comprising:

a body having flangeways that intersect; and a plurality of connection plugs extending from the body for connecting to a running rail;

wherein at least one of the flangeways has a floor surface having a convex cross-section defined by a first arc, a second arc and a third arc; the first arc extending from a first point to a second point; the second arc extending from the second point to a third point; the third arc extending from the third point to a fourth point; the first and fourth points being at flangeway depths so as to avoid contact with a flange of train wheel passing through the flangeway; wherein upon the train wheel entering the flangeway, the flange of the train wheel initially contacts the floor at the first arc; and wherein upon the train wheel exiting the flangeway, the flange of the train wheel disengages the floor at the third arc.

5. A method of connecting two running rails for intersection in a railroad comprising:

providing a railroad frog apparatus having a body with two intersecting flangeways and four connection plugs extending from the body, each of the connection plugs having cross-sectional profiles that are substantially identical to a cross-sectional profile of a corresponding running rail to which the connection plug is to be connected;

butting the running rails against the corresponding connection plug; and welding each running rail to the corresponding connection plug;

wherein at least one of the flangeways of the railroad frog apparatus has a floor surface having a convex cross-section defined by a first arc of constant radius, a second arc of constant radius and a third arc of constant radius; the first arc extending from a first point to a second point; the second arc extending from the second point to a third point; the third arc extending from the third point to a fourth point; the first and fourth points being at flangeway depths so as to avoid contact with a flange of train wheel passing through the flangeway; wherein upon the train wheel entering the flangeway, the flange of the train wheel initially contacts the floor at the first arc; and wherein upon the train wheel exiting the flangeway, the flange of the train wheel disengages the floor at the third arc.

* * * * *